United States Patent [19]

Nopanen

[11] 4,003,388

[45] Jan. 18, 1977

[54] HAIR DRYER VARIABLE CONTROL

[75] Inventor: Esko J. Nopanen, Asheboro, N.C.

[73] Assignee: General Electric Company, Bridgeport, Conn.

[22] Filed: Apr. 1, 1976

[21] Appl. No.: 672,611

[52] U.S. Cl. ..... 132/9; 34/91

[51] Int. Cl.[2] ..... A45D 20/00

[58] Field of Search ..... 132/9, 11 R, 11 A; 34/91–97

[56] References Cited

UNITED STATES PATENTS

| | | | |
|---|---|---|---|
| 3,903,905 | 9/1975 | Tucker | 132/9 |
| 3,911,934 | 10/1975 | Helbling | 132/9 |
| 3,934,596 | 1/1976 | Suntheimer | 132/9 |

*Primary Examiner*—G.E. McNeill

*Attorney, Agent, or Firm*—John F. Cullen; George R. Powers; Leonard J. Platt

[57] ABSTRACT

In a hair dryer having an electric selectively variable motor driven fan, and plural wattage heaters in the fan stream for selectively heating the air and having thermostat means sensing air temperature to shut off the dryer on an over-temperature condition, an improvement is provided in a combination switch and sliding contact variable control for heat and speed that comprises an elongated continuous bus bar connected to one side of the line with two separate sets of discrete spaced contacts being spaced on opposite sides of the bus bar parallel thereto and to each other. Two separate sliding means are provided each being sized to bridge at least two spaced contacts in a set as it moves along the bar parallel to the other sliding means. One of the sliding means provides smooth continuous adjustment of a preferably segmented resistance in the heating circuit and the other sliding means provides smooth continuous adjustment of a preferably segmented resistance in the motor driven fan circuit for independent smooth heat adjustment and fan speed of the dryer. Additionally, an automatic pick-up structural interlocking means between the two sliding means prevents overheating by increasing the fan speed as the heat is increased.

8 Claims, 4 Drawing Figures

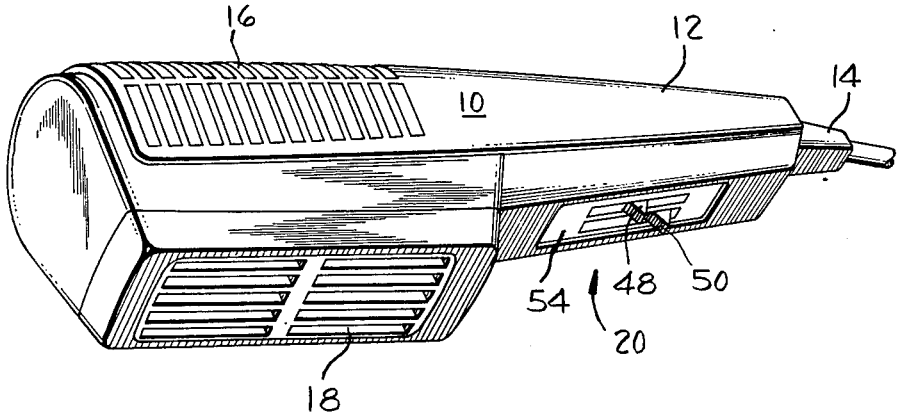
Fig. 1.
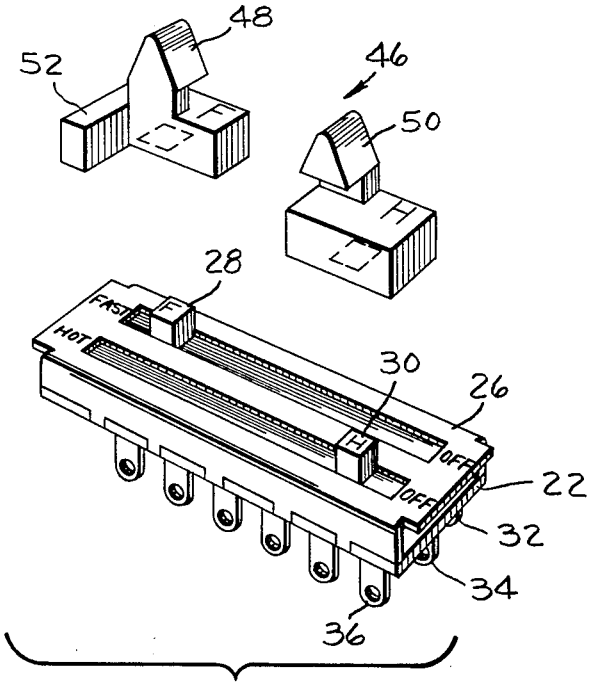
Fig. 2.
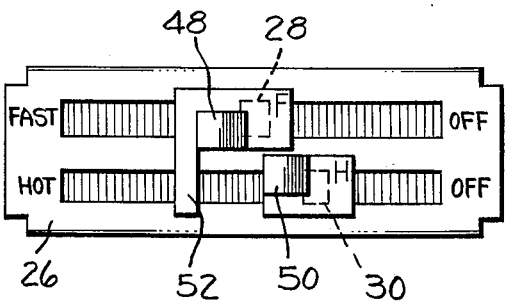
Fig. 3.
Fig. 4.
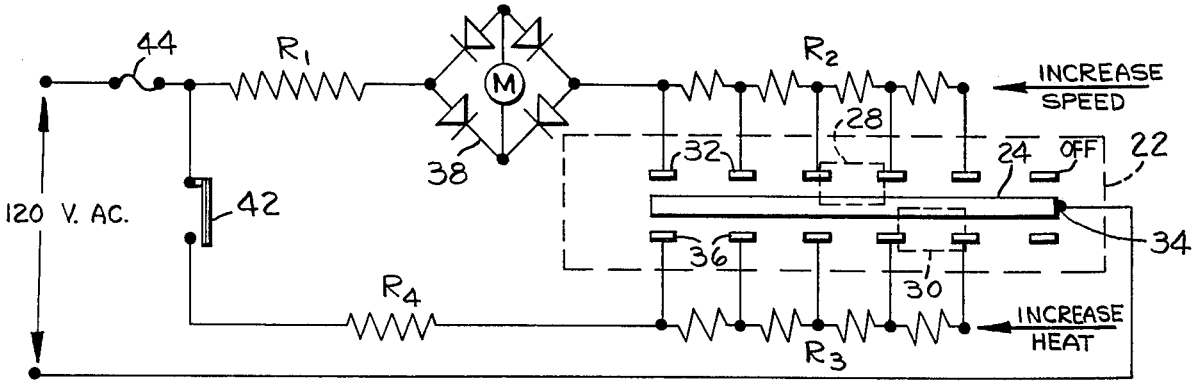

HAIR DRYER VARIABLE CONTROL

BACKGROUND OF THE INVENTION

1. Field of the Invention

This invention relates to electric hair dryers and more particularly to a combination switch and variable control therefor which provides smooth continuous fan speed and heat adjustment while insuring the heat cannot be set too high without the fan being proportionately set to prevent over-temperature.

2. Description of the Prior Art

Various types of hand-held dryers of different wattages have come into vogue. These are generally classified as purse-type styling, or pistol-type dryers. The prime difference is in the overall shape since each is used for drying and styling the hair. Generally, the dryers have a blower and heater assembly to direct hot air stream over the hair as it is combed or brushed and they may have various attachments to style the hair while drying. The dryers include motor-driven fans of the cross-flow, centrifugal, or tangential type, and usually include a form of heater support or box structure mounting plural wattage heaters of coil resistance wires across the fan stream downstream thereof. Normally, thermostat means is disposed in the air flow to sense temperature rise of the air due to varying causes such as fan blockage, exit air blockage, or heat rises caused by frictional obstructions of one sort or another. On an over-temperature condition, the thermostat disconnects the heaters and shuts either the entire system down or the heater system permitting the fan motor to continue for cooling purposes. In such dryers it is desirable for the user to be able to adjust the amount of air flow and the amount of heat for different hair styling and drying conditions and thus vary both the speed and heat of the dryers. In currently available dryers, these two variables of speed and heat are controlled in generally two ways: first, by switch action in which independent or interconnected switching structure is used; or second, the variables may be controlled by electronic circuitry. The switch method is the most common but is usually limited to a few discrete operating points and the number of speeds and heats available are not always adequate for all drying and styling conditions. The electronic control overcomes this limitation by making the adjustment variable over some range of speeds and heats, but its disadvantage is the complexity and cost of the circuitry needed to control the variables especially on high wattage dryers. Neither the switch method nor the electronic control method usually gives independent control of speed and heat without considerable added cost and complexity and normally one control discretely changes both speed and heat together. Further, both 120 volt AC systems or lower voltage DC motors may be used. In the DC case it is common to obtain correct motor voltage by connecting resistance in series with the motor, the resistance consisting of low wattage heaters which thus serve the dual purpose of reducers for voltage control and a source of low wattage heat — the more common way of reducing cost in styling dryers. In the 120 volt AC system, the heater resistance is usually connected in parallel across the motor and may be independently variable. Thus, by using plural or several differing resistance wires or variable adjustments, various wattages may be obtained all as well known. Except for the electronic control, the various adjustments are usually discrete detented points on a knob adjustment. Thus, an improved and simplified variable control for both heat and fan speed in a hair dryer is desired which control replaces complex mechanical or electronic switches and provides the "feel" of a smooth infinitely continuous adjustment of both speed and heat while, at the same time preventing an over-temperature condition by ensuring that the heat setting is never on high unless a comparable fan speed is provided for adequate cooling.

SUMMARY OF THE INVENTION

Briefly described, the invention is directed to a hair dryer with an electric selectively variable motor driven fan and plural wattage heaters in the fan stream to selectively heat the air and with thermostat means to shut off the dryer in an over-temperature condition. In this setting, there is provided an improved combination switch and sliding contact variable control for both heat and speed which comprises an elongated continuous bus bar connected to one side of the line and a plurality of two separate sets of discrete spaced contacts on opposite sides of the bus bar parallel thereto and to each other. Connected with the bar and contacts are two separate sliding means each being sized to bridge at least two spaced contacts in its set as the slide moves along the bar parallel to the other sliding means, one of the sliding means providing smooth continuous adjustment of resistance in the heating circuit and the other in the motor driven fan circuit for independent smooth adjustment of the two variables. Additionally, an interlock is provided between the sliding means that provides for a pick-up of the fan sliding means by the heat sliding means in the increasing direction so that at high heat the fan is automatically turned to high speed for adequate cooling thus preventing a high heat/low fan speed condition. Finally, there is provided a single segmented resistance in each of the heat and fan circuits which is contacted to successively bring in or out portions of the resistance in the respective circuits as the sliding means moves along the bar from one spaced contact to the other. Thus, the main object is to provide a simplified mechanical variable control in hair dryers which has the "feel" of an infinitely variable adjustment and provides adequate cooling on high heat settings.

BRIEF DESCRIPTION OF THE DRAWING

FIG, 1 is a perspective view of a typical styling dryer in which the invention is used;

FIG. 2 is an exploded perspective view of the sliding contact variable control;

FIG. 3 is a top view of assembled FIG. 2; and

FIG. 4 is a schematic circuit diagram of the invention as applied to a low voltage DC motor system.

DESCRIPTION OF THE PREFERRED EMBODIMENT

While the invention is applicable to any general style of hand-held hair dryer or even stand or bonnet dryers, it will be described in connection with a common styling dryer that employs a low voltage DC motor. Referring to FIG. 1, there is shown a typical hand-held styling dryer with a casing 10 having a supporting handle 12 extending generally parallel to the side and connected electric cord 14 to power the dryer. Such dryers generally have a motor driven fan internally supported receiving air through inlet 16, passing it across plural wattage downstream heaters and directing the heated air through outlet 18. The internal plural wattage heaters are different resistance wires that are generally supported in a heater box upstream of outlet 18 and are connected into and out of the heating circuit as selected for various operating conditions. Both heat and fan speed may be variable by a control generally indicated at 20 disposed in the handle which control heretofor, has been either electronic or a discrete detented control by a switch or a pair of switches. This general arrangement is well know and a similar dryer with detangling attachment is shown in U.S. Pat. No. 3,840,030 of common Assignment. In this general arrangement, an improved combination switch and sliding contact variable control is provided. In prior devices, a single switch is normally used to control both speed and heat and operates at predetermined detented positions. The present invention replaces the prior mechanical type controls by providing two sliding means in the form of control knobs 48, 50 that project from the handle of the dryer; one 48 for controlling motor speed and the other 50 for controlling heater wattage. In addition, the ON/OFF position for both speed and heat are at one end of travel of the knobs. The structure is such that the variable adjustment of the heat and speed parameters is actually in discrete steps but the steps are so small and on only one side so that the "feel" of adjustment is that of being infinitely variable by permitting the control knobs to slide smoothly from one end of travel to the other on the other side on a continuous bus bar without the normal detents felt on switches.

To this end, there is provided a suitable base member 22 on which there is mounted an elongated continuous bus bar 24 that is connected to one side of the 120 volt AC line as shown in FIG. 4. This base and contained bus bar 24 is secured in a compact slotted housing 26 designed to accommodate sliding fan control means 28 and sliding heater control means 30 that independently adjust the fan speed and wattage respectively. In order to complete the circuit, with respect to the fan motor speed, there is provided on one side of the bus bar and connected to the other side of the line, a plurality of discrete fixed spaced contacts 32 carried in base member 22 and extending below thereof as shown in FIG. 2. The central bus bar 24 is connected to the line by a suitable depending lug 34. Similarly, a separate set of discrete spaced contacts 36 for the heater circuit is provided on the other side with both sets spaced on opposite side of bus bar 24 and parallel thereto and to each other with the separate spaced sets being symmetrical to each other as clearly shown in FIG. 4. This control device with the dual adjustment capability is wired to resistors R2 and R3 (heaters) inside the dryer. The control 28 associated with fan speed is connected to a resistor R2 in series with motor M operating through full wave rectifier 38. This resistance R2 may be, but not necessarily, single and is segmented to provide different voltages to the motor to change the motor and thus fan speed. While any number of segments can be used, as shown resistor R2 is divided into four segments resulting in five different motor speeds separated by about 1,000 rpm and OFF with the fan speed increasing as portions of the segments are successively connected to cut out of the circuit on movement of sliding fan means 28 to the left as shown in FIGS. 2 and 4 so each contact is connected to change resistance in its' respective circuit for each spaced contact position of the sliding means. Thus, the resistance in the fan circuit includes the segmented resistance R2 as well as the fixed resistance R1. In order to obtain the "feel" of infinitely variable adjustment, the sliding contacts 28 and 30 are sized to bridge at least two spaced contacts as shown in FIG. 4 so that the circuit of a different resistance is made before the circuit with the previous resistance is broken as the sliding contact 28 is moved. While these are specific increments 32, by making one circuit before the prior circuit is broken and having one side of the contact 28 sliding on continuous bus bar 24, the speed control is a smooth continuous adjustment from one end of the bar to the other without the normal detent feel on discrete detented switches.

The heat side of the control is similarly connected to a similar segmented resistance as previously described by the symmetrical arrangement of spaced discrete contacts 36 on the other side with bridging sliding heater means 30 and the heater side being connected to resistor R2 in series with the main heating resistor R4. Again, four segments of resistor R3 give five different wattages in addition to OFF - here, the far right position. The heater circuit is completed by a suitable thermostat 42 to open on an over-temperature condition. A secondary protective fuse 44 is also provided.

Since both speed and heat controls are independent as described, the potential hazard of overheating must be eliminated, that is, the heat generated by heating element R1 - R4 must never exceed the capability of the air flow to dissipate it. This safeguard is provided by a mechanical interlocking of the two sliding contracts 28 and 30 which interlock is generally shown at 46 in FIG. 2. It may comprise a pair of buttons, such as fan button 48 and heat button 50, that fit on the respective sliding means 28 and 30 for control by the user. To prevent movement of the heat button 50 the left HOT heat position as shown in FIGS. 3 and 4 without a comparable increase in the fan speed to dissipate the heat, the interlock includes an arm 52 which connects the sliding means together, it is provided on the fan control sliding means 30 as shown in FIG. 3. The arm is so disposed that the one heat control sliding means 30 picks up and moves parallel together with the other fan control sliding means 28 in one direction only — in the direction of higher fan speed as the heat is increased to avoid an over-temperature condition.

The entire compact simple mechanical combination switch and sliding variable control 20 is conveniently located in the dryer handle 12 with the bus bar extending generally parallel to the longitudinal axis of the handle as shown in FIG. 1. Thus, the user has a simple one-handed adjustment of both speed and heat controls by conveniently sliding the thumb against either the fan button 48 or heat button 50 extending through indicia plate 54 concealing the interlock structure.

Thus, the simple mechanical control provides an infinitely variable smooth sliding fan and heat control interlocked to prevent high heat with low fan speed and which uses a resistance in each circuit as a segmented resistance whereby each segmented single resistance can be used to control variable fan speeds and heat levels in a hair dryer.

While there has been shown a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In a hair dryer having an electric selectively variable motor driven fan, plural wattage heaters disposed in the fan stream for selectively heating the air, and thermostat means sensing air temperature to shut off the dryer on over-temperature condition, the improvement in a combination switch and sliding contact variable control for heat and speed comprising, an elongated continuous bus bar connected to one side of the line, a plurality of discrete fixed spaced contacts connected to the other side of the line with each contact connected to change resistance in the circuit, sliding contact means connecting said bar and spaced contacts to complete the circuit, said sliding means being sized to bridge at least two spaced contacts as it moves along said bar for a smooth continuous adjustment of resistance in the circuit as the movable contact slides from one end of the continuous bar to the other.

2. Apparatus as described in claim 1 wherein the discrete spaced contacts are also spaced from the bus bar and extend parallel thereto.

3. Apparatus as described in claim 1 wherein two separate sets of discrete spaced contacts are provided, each set being spaced on opposite sides of the bus bar parallel thereto and to each other, two separate sliding means, each sliding means being sized to bridge at least two spaced contacts in a set as it moves along said bar parallel to the other sliding means, one sliding means providing smooth continuous adjustment of resistance in the heating circuit and the other sliding means providing smooth continuous adjustment of resistance in the motor driven fan circuit for independent smooth heat adjustment and fan speed in said dryer.

4. Apparatus as described in claim 3 wherein said sliding means are interlocked for movement together in one direction only by movement of one of said sliding means.

5. Apparatus as described in claim 4 wherein said interlock connects said sliding means together for movement of said other sliding means controlling the motor driven fan circuit for higher fan speed by said one sliding means controlling the heating circuit as it is adjusted for higher heat.

6. Apparatus as described in claim 5 wherein said interlock includes, an arm on said fan control sliding means extending into the path of said heat control sliding means disposed so that said heat control sliding means picks up and moves said fan control sliding means in the direction of higher fan speed for higher heat to avoid an over-temperature condition.

7. Apparatus as described in claim 6 wherein said dryer has a handle and said bus bar extends generally parallel to the longitudinal axis of the handle for one-handed operation by the user.

8. Apparatus as described in claim 6 wherein part of the resistances in both the heating and fan circuits include a segmented resistance respectively and said respective sliding means connect portions of the segmented resistances for each spaced contact position of its sliding means.

* * * * *